US008302663B2

(12) United States Patent
Eichholz et al.

(10) Patent No.: US 8,302,663 B2
(45) Date of Patent: Nov. 6, 2012

(54) CASTING NOZZLE FOR A HORIZONTAL CONTINUOUS CASTING SYSTEM

(75) Inventors: Hellfried Eichholz, Ilsede (DE); Sven Klawiter, Sarstedt (DE); Rune Schmidt-Jürgensen, Hannover (DE); Karl-Heinz Spitzer, Clausthal (DE); Hans-Jürgen Hecken, Schuld (DE); Jochen Schlüter, Siegen (DE)

(73) Assignees: Salzgitter Flachstahl GmbH, Salzgitter (DE); SMS Siemag AG, Düsseldorf (DE)

( * ) Notice: Subject to any disclaimer, the term of this patent is extended or adjusted under 35 U.S.C. 154(b) by 0 days.

(21) Appl. No.: 13/255,588

(22) PCT Filed: Feb. 15, 2010

(86) PCT No.: PCT/DE2010/000214

§ 371 (c)(1),
(2), (4) Date: Nov. 18, 2011

(87) PCT Pub. No.: WO2010/102600

PCT Pub. Date: Sep. 16, 2010

(65) Prior Publication Data

US 2012/0138257 A1 Jun. 7, 2012

(30) Foreign Application Priority Data

Mar. 12, 2009 (DE) ..... 10 2009 012 985

(51) Int. Cl.
*B22D 11/06* (2006.01)
*B22D 11/10* (2006.01)

(52) U.S. Cl. ..... 164/437; 164/429; 164/440

(58) Field of Classification Search ..... 164/488–490, 164/437–440, 479–482, 429–434
See application file for complete search history.

(56) References Cited

U.S. PATENT DOCUMENTS

| | | | |
|---|---|---|---|
| 4,593,742 | A | 6/1986 | Hazelett et al. |
| 4,716,956 | A | 1/1988 | Hoffman et al. |

FOREIGN PATENT DOCUMENTS

| | | | |
|---|---|---|---|
| DE | 19636697 | C1 | 8/1997 |
| EP | 0 635 323 | A1 | 1/1995 |
| GB | 2 013 855 | A | 8/1979 |
| JP | 58-199649 | | 11/1983 |
| WO | WO2006/089419 | | 8/2006 |
| WO | WO2007/087686 | | 8/2007 |

OTHER PUBLICATIONS

Karl_Heinz Spitzer et al.: "Direct Strip casting (DSC)—an Option for the Production of New Steel Grades", in: steel research, vol. 74, No. 11/12, 2003.

André Ditze et al.: "Strip casting of magnesium with the single-belt process", in: Scandinavian Journal of Metallurgy, No. 32, 2003, pp. 311-316.

*Primary Examiner* — Kuang Lin
(74) *Attorney, Agent, or Firm* — Henry M Feiereisen LLC

(57) ABSTRACT

The invention relates to a casting nozzle for a horizontal strip casting system, especially for casting steel strip. The casting nozzle is connected to a feed channel and is designed as a rectangular refractory hollow block, the outlet region of which being only slightly above the cooled continuous belt which accommodates the outflowing melt. The hollow block is subdivided at least once in the direction of casting and a narrow sealing element is arranged on the partition side of the segments, the width of the remaining gaps in the partition area being selected as to close when the casting nozzle is operated.

11 Claims, 3 Drawing Sheets

A-A

B-B

CASTING NOZZLE FOR A HORIZONTAL CONTINUOUS CASTING SYSTEM

CROSS-REFERENCES TO RELATED APPLICATIONS

This application is the U.S. National Stage of International Application No. PCT/DE2010/000214, filed Feb. 15, 2010, which designated the United States and has been published as International Publication No. WO 2010/102600 A1 and which claims the priority of German Patent Application, Serial No. 10 2009 012 985.5, filed Mar. 12, 2009, pursuant to 35 U.S.C. 119(a)-(d).

BACKGROUND OF THE INVENTION

The invention relates to a casting nozzle for a horizontal strip casting facility, in particular for casting steel strip. Such casting facilities require liquid steel to be applied upon a cooled continuous belt from the nozzle which forms a casting channel.

Such a casting nozzle is known from "Direct Strip Casting" (DSC)—an Option for the Production of New Steel Grades"—steel research 74 (2003) No. 11/12 p. 724-731.

In this known arrangement, liquid steel flows from a distributor via a horizontally aligned feed channel into the casting nozzle which has a rectangular channel in cross section surrounded by refractory material. The casting nozzle is configured as a rectangular hollow block which is made from refractory material. Arranged in the outlet region of the casting nozzle is a so-called upper weir at the top element and a so-called lower weir at the bottom element. Both weirs interact together to form a siphon to keep back slurry residue left in the melt.

DE 196 36 697 C1 discloses a casting nozzle for thin strip casting facilities, having a backup dam which is placed upon a carrier movable in conveying direction for the thin strip, and a front dam which delimits the casting gap towards the carrier in conveying direction. According to a preferred embodiment, several outlet openings for the melt are provided in side-by-side relationship in direction of the width of the thin strip between back dam and front dam.

In this way, a more uniform distribution of the melt over the width of the casting gap should be realized. The formation of outlet openings should be realized through respective configuration of the back dam or front dam. No details are given in this regard.

For economic reasons, it is desirable to cast broadest possible steel strips. When the casting width is, e.g. >300 mm, most different problems are encountered during operation of the casting nozzle.

On one hand, this relates to the static strength of the refractory material, in particular of the top element, which is designed as a carrier upon two supports. On the other hand, substantial thermal expansions of the substructure are encountered during continuous operation and alter the clear cross section of the casting nozzle in an undesired manner. Also the production of very broad casting nozzles of refractory material drives up costs in a way that is no long justifiable.

SUMMARY OF THE INVENTION

It is an object of the invention to be able to use the proven casting nozzle, configured as rectangular hollow block, also for strip widths of >300 mm at justifiable production costs.

In accordance with the invention, this object is solved by a casting nozzle for a horizontal strip casting facility, in particular for casting of steel strip, connected to a feed channel and configured as a rectangular hollow block made from refractory material and having an outlet zone located only slightly above a cooled continuous belt which receives the outflowing melt, wherein the hollow block is split at least once in the casting direction and a narrow sealing element is arranged at the partition area of the segments, with the width of the remaining gaps in the partition zone being selected such as to close during operation of the casting nozzle. Advantageous refinements are the subject matter of sub-claims.

Deflection encountered during operation of the casting nozzle is limited to single shorter segments and thus can be controlled.

The partition areas are sealed by arranging a sealing element between the segments. Preferably, this involves a felt of refractory material on the basis of $Al_2O_3$, known also under the trade name "Pyrostop". This material can withstand temperatures of up to 1600° C. Depending on the thermal expansion of the used refractory material for the casting nozzle, the width of the sealing element should lie at 1-2 mm.

The gaps remaining during assembly of the individual segments in the partition zones are to be selected such that the partition zones close during operation of the casting nozzle as a result of thermal expansion.

A drawback of the multipart configuration of the casting nozzle involves the arrangement of a support web between top and bottom elements in the respective partition zone because the latter leads to a division of the steel flow. To ensure a confluence of flow in the outlet region, the width of the support web should thus be as small as possible and preferably not exceed 10-20 mm.

To facilitate the shift of the segments transversely to the casting direction as a result of thermal expansion, the bottom elements have corresponding stepped projections, respectively.

A formfitting connection of the casting nozzle with the feed channel is realized by configuring the part in opposition to the casting direction as clamping portion. The width and also the height are smaller than the front portion.

Furthermore, the upper side of the top element as well as the underside of the bottom element of this clamping portion is provided with a slant ascending in opposition to the casting direction. Preferably, the upper side of the top element of the clamping portion connects without projection with the upper side of the top element of the front portion.

When great casting widths are involved, it may be advantageous to provide not one but several partition areas. A modular construction is proposed for such cases. It is characterized by segments arranged to the right and left, respectively.

Both segments are configured almost as mirror images of one another. The qualification "almost" relates to the stepped projection. The segment arranged in between may be selected wider or narrower depending on the desired casting width.

When arranging two intermediate segments, both segments are configured identical for cost reasons.

The proposed multipart construction of the casting nozzle has the advantage that the individual segments have the required static strength, can be produced more cost-efficiently, and enable a modular construction for varying casting widths.

BRIEF DESCRIPTION OF THE DRAWING

An exemplary embodiment of the casting nozzle is described in greater detail.

It is shown.

DETAILED DESCRIPTION OF PREFERRED EMBODIMENTS

Figure 1:
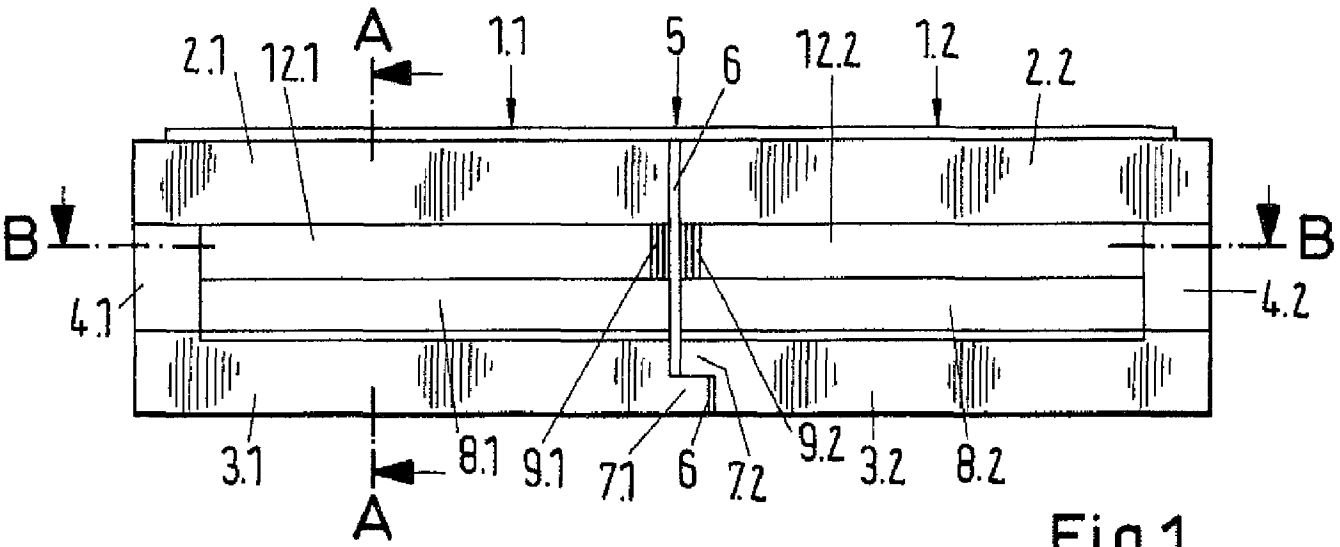
FIG. 1 a view in opposition to the casting direction of a two-part casting nozzle, FIG. 2 a top view of FIG. 1, FIG. 3 a section along A-A in FIG. 1, FIG. 4 a section along B-B in FIG. 1, FIG. 5 a view in casting direction of FIG. 1, FIG. 6 a view in opposition to the casting direction of a four-part casting nozzle.
Figure 2:
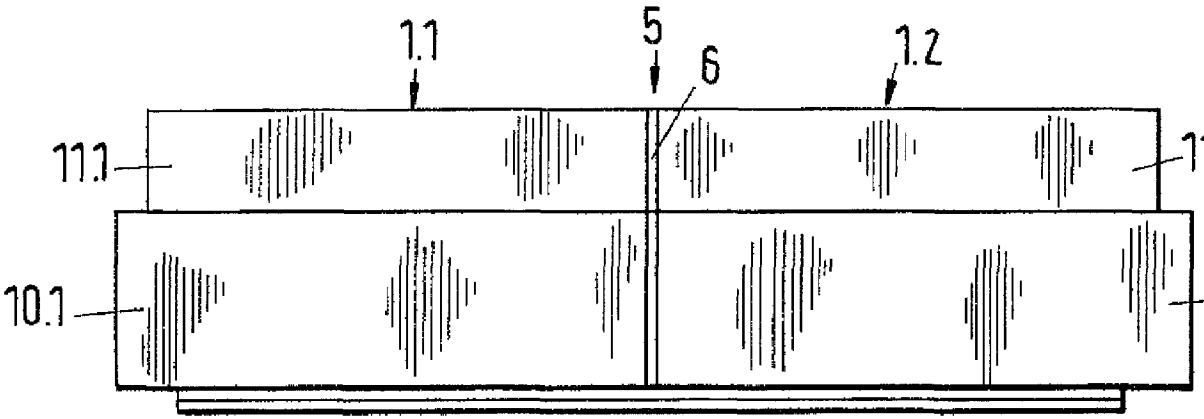
Figure 3:
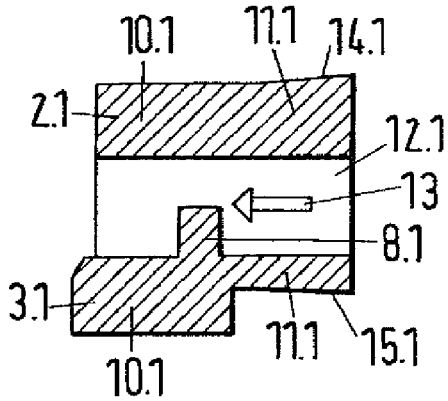
Figure 4:
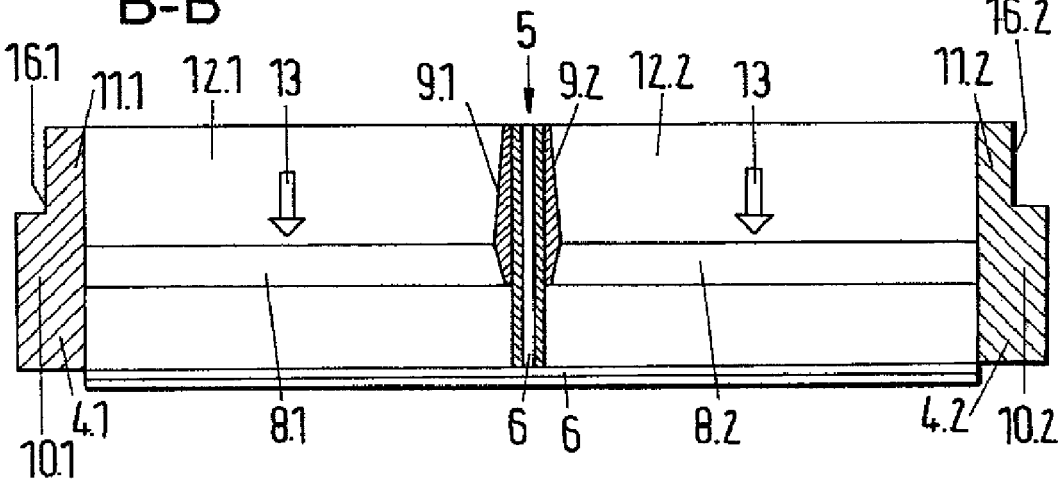
Figure 5:
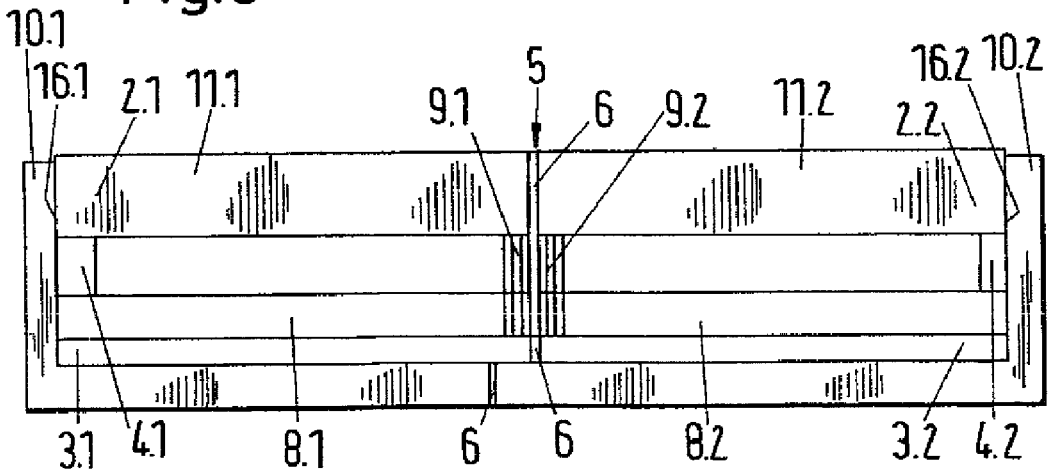

Illustrated in FIGS. 1 and 5 are two views, in FIG. 2 a top view, and in FIGS. 3 and 4 two sections of a casting nozzle split in accordance with the invention with the two segments 1.1, 1.2.

The segments 1.1, 1.2 are configured identical almost as mirror images of one another, each with a top element 2.1, 2.2, a bottom element 3.1, 3.2, and a side element 4.1, 4.2. Arranged at the partition area 5 between both segments 1.1, 1.2 is a sealing element 6 of a thickness of 1-2 mm.

To improve guidance of both segments 1.1, 1.2 during the sliding motion transversely to the casting direction 13 (FIG. 3, FIG. 4), the bottom elements 3.1, 3.2 are provided at the partition area 5 with corresponding stepped projections 7.1, 7.2, respectively. The qualification of the configuration of both segments 1.1, 1.2 as almost identical mirror images of one another relates to this stepped projection 7.1, 7.2.

The gaps remaining during assembly of both segments 1.1, 1.2 in the partition area 5 are selected in width such as to close during operation of the casting nozzle as a result of thermal expansion.

The view shown in FIG. 1 renders visible the front side of the lower weirs 8.1, 8.2 at the bottom elements 3.1, 3.2, respectively. In FIG. 3, the details are illustrated for this.

In order to be able to support the top elements 2.1, 2.2 against the bottom elements 3.1, 3.2, respectively, support webs 9.1, 9.2 are arranged respectively. Details are illustrated in FIG. 4.

The top view according to FIG. 2 shows that each segment 1.1, 1.2 has a front portion 10.1, 10.2 and a clamping portion 11.1, 11.2. Details are described with reference to FIGS. 3 and 4.

FIG. 3 involves a section along the line A-A in FIG. 1. This section shows on one hand the horizontal channel 12.1 between top element 2.1 and bottom element 3.1 and on the other hand the lower weir 8.1 arranged at the bottom element 3.1. The open arrow marked in the channel 12.1 illustrates the casting direction 13.

A formfitting connection of the casting nozzle with the feed channel, not shown here, is realized by configuring the part of the respective segments 1.1, 1.2 in opposition to the casting direction 13 as clamping portion 11.1, 11.2. For that purpose, the upper side of the top element 2.1 has in the clamping portion 11.1 a slant 14.1 ascending in opposition to the casting direction 13. Likewise, the underside of the bottom element 3.1 in the clamping portion 11.1 has a slant 15.1 ascending in opposition to the casting direction. The angle of inclination of both slants is in the range of $\geqq 5°$.

FIG. 4 involves a section along the line B-B in FIG. 1. This section shows the straight configuration of the side surfaces 16.1, 16.2 of the clamping portions 11.1, 11.2, respectively. Reference should also be made to the double-cone configuration of the respective support webs 9.1, 9.2.

Such a configuration has the advantage of establishing a flow-enhancing course of the melt with sufficient stiffness of the support pillars.

The view in FIG. 5 in casting direction shows that the clamping portion 11.1, 11.2 have a height and width which are smaller than the respective front portion 10.1, 10.2. The backside of the lower weir 8.1, 8.2 is also visible. The support webs 9.1, 9.2 have a greater height in comparison to FIG. 1, because it extends up to the upper side of the respective bottom element 3.1, 3.2.

Figure 6:
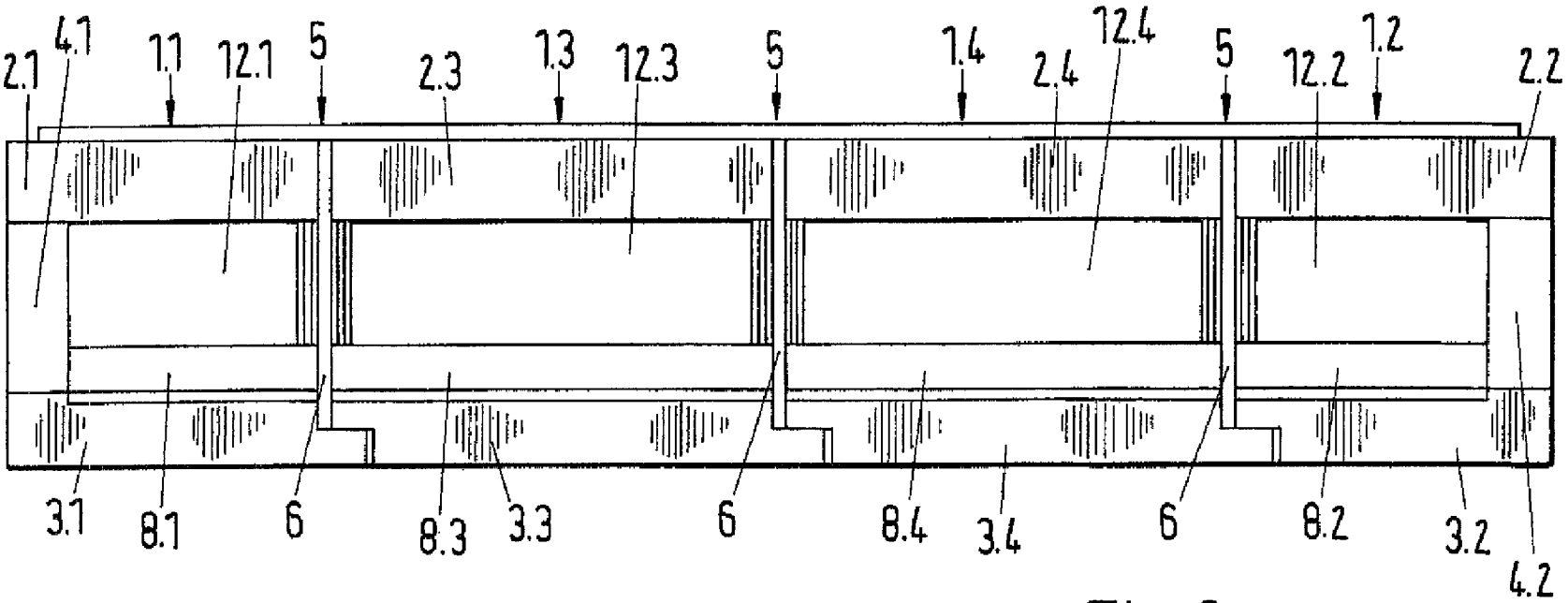

FIG. 6 shows a four-part casting nozzle by way of a same view as FIG. 1 with segments 1.1, 1.2 at the margins, respectively, and two center segments 1.3, 1.4. As already mentioned with reference to FIG. 1, in terms of a modular construction both outer segments 1.1, 1.2 are configured almost identical as mirror images of one another and both center segments 1.3, 1.4 are configured identical. Depending on the desired casting width, this permits to constantly use the two outer segments 1.1, 1.2 and to place one or two center segments 1.3, 1.4 in between and to appropriately select the width of the center segment or segments 1.3, 1.4.

What is claimed is:

1. A casting nozzle in a horizontal strip casting facility, said casting nozzle comprising:

a hollow block made from refractory material and having a melt outlet zone located above a cooled continuous belt of the horizontal strip casting facility, said hollow block being split at least once in a casting direction to define two segments separated by a partition area; and a sealing element arranged at the partition area of the segments in such a way that a remaining gap in the partition area is defined by a width to allow closing of the gap during operation of the casting nozzle.

2. The casting nozzle of claim 1, wherein the hollow block is rectangular.

3. The casting nozzle of claim 1, wherein the sealing element is a felt of refractory material on the basis of $Al_2O_3$.

4. The casting nozzle of claim 1, wherein the sealing element has a thickness of 1-2 mm.

5. The casting nozzle of claim 1, wherein each of the segments of the hollow block has a bottom element, said bottom element of one of the segments abutting the bottom element of the other one of the segments at the partition area, said bottom elements having complementing stepped projections which extend transversely to the casting direction.

6. The casting nozzle of claim 1, wherein each of the segments of the hollow block has a bottom element and a top element, and further comprising a support web arranged next to the partition area to connect the top element with the bottom element of each segment.

7. The casting nozzle of claim 6, wherein the top element and the bottom element define a channel, said support web having a surface disposed in facing relationship to the channel and having a double-cone configuration in the casting direction.

8. The casting nozzle of claim 1, wherein each of the segments of the hollow block has a bottom element provided with a front portion and a clamping portion, and a top element provided with a front portion and a clamping portion wherein each of the clamping portions of the bottom and top elements is defined transversely to the casting direction by a width and by a height which are smaller than the front portion thereof, wherein an upper side of the clamping portion of the top element and an underside of the clamping portion of the bottom element have each a slant which ascends in opposition to the casting direction.

9. The casting nozzle of claim 8, wherein the upper side of the clamping portion of the top element connects without projection with the upper side of the front portion of the top element.

10. The casting nozzle of claim 1, wherein the hollow block has two partition areas separating an intermediate segment from the two segments placed on either side of the intermediate segment and separated therefrom by the partition areas, respectively, said two segments being configured identical almost as mirror images of one another, wherein the intermediate segment has a width which is suited to a desired casting width.

11. The casting nozzle of claim 1, wherein the hollow block has three partition areas, separating two center segments from each other and from the two segments which are arranged on opposite sides of the hollow block, said two segments being configured identical almost as mirror images of one another, and said two center segments being configured identical.

* * * * *